US005172398A

United States Patent [19]

Simons

[11] Patent Number: 5,172,398

[45] Date of Patent: Dec. 15, 1992

[54] METHOD AND DEVICE FOR RECORDING CHARGES FOR COPIES MADE ON A COPYING MACHINE

[75] Inventor: Peter J. J. M. Simons, Beesel, Netherlands

[73] Assignee: Oce-Nederland, B.V., Venlo, Netherlands

[21] Appl. No.: 774,538

[22] Filed: Oct. 8, 1991

[30] Foreign Application Priority Data

Oct. 8, 1990 [NL] Netherlands ..... 9002177

[51] Int. Cl.[5] ..... G06M 3/08

[52] U.S. Cl. ..... 377/13; 377/14; 377/37; 194/210; 235/381; 355/113

[58] Field of Search ..... 377/13, 14, 37; 194/210; 235/381; 355/113

[56] References Cited

U.S. PATENT DOCUMENTS 3,653,480 4/1972 Yamamoto et al. ..... 194/210
3,872,282 3/1975 Long ..... 377/13
4,124,109 11/1978 Bissell et al. ..... 194/210
4,173,408 11/1979 Stewart ..... 377/13
4,260,878 4/1981 Kawamura et al. ..... 377/13
4,272,757 6/1981 McLaughlin et al. ..... 377/13

*Primary Examiner*—William L. Sikes
*Assistant Examiner*—Scott A. Ouellette
*Attorney, Agent, or Firm*—Birch, Stewart, Kolasch & Birch

[57] ABSTRACT

A device for selectively recording charges for copies made on a copying machine by way of two or more accounting means connected at the same time via the device to the copying machine, comprising means for coupling the device to the copying machine, a plurality of connection points each one of which is connectable separately to a different accounting means and control means which selectively activates one of the accounting means for recording of the charges and the method of accomplishing the recording of such charges.

11 Claims, 7 Drawing Sheets

METHOD AND DEVICE FOR RECORDING CHARGES FOR COPIES MADE ON A COPYING MACHINE

BACKGROUND OF THE INVENTION

1. Field of the Invention 5 This invention relates to a method of recording charges made on a copying machine, and more specifically to a system whereby different accounting devices are separately connectable to a copying machine for the purpose of registering charges for photocopying.

2. Discussion of Related Art

U.S. Pat. No. 4,519,088 discloses a method whereby different types of accounting devices can be connected to a copier and, when connected, are each adapted to be used for activating the connected copying machine. In the known method, when it is required to change over from a first type of accounting device to a second type of accounting device in order to record the charges for the copies, it is presently a disadvantage that the connection to the first accounting device has to be disconnected in order to prevent the charges from being made against both of the first and second accounting devices.

SUMMARY OF THE INVENTION

Therefore, it is an object of the present invention to provide a method and device for recording charges for copies made on a copying machine which will overcome the above noted disadvantage.

It is a further object of the present invention to provide a method of recording copying charges of copies made on a copying machine utilizing different accounting devices.

Yet, a further object of the present invention is to provide a device for integrating the recording of copier charges for copies made on a copying machine with more then one accounting device.

According to the present invention, the foregoing objects and others are accomplished by providing a method and apparatus whereby two or more accounting devices may be connected at the same time to a copying machine while only one of the connected accounting devices is predetermined for activation. Consequently, no charge is made against any of the accounting devices other than the predetermined one, even if all of the accounting devices remain connected.

In one embodiment of the present invention, only that accounting device which is the last one connected of the connected accounting devices is activatable as the predetermined accounting device. Consequently, only one of the connected accounting devices is debited even if the other accounting devices remain connected.

A device for performing the method according to the present invention is adapted to be coupled to a copying machine and is provided with a number of connection points to each of which an accounting device is connectable. Control means are provided for activating a specific accounting device of the connected accounting devices, the control means comprising a number of priority value counters each corresponding to a different connection point, and a counter setting means which sets a priority value counter to a highest priority value when a connection is made between the connection point corresponding to the priority value counter and an accounting device, which counter setting means sets the priority value counter to a lower priority value whenever, on connection of an accounting device to a connection point corresponding to the priority value counter, a connection is made between another connection point and an accounting device and sets the priority value counter to a priority value of 0 when the connection between the connection point corresponding to the priority value counter and an accounting device is broken or interrupted. The device also includes a switching means for rendering activatable, during copying, that accounting device which is connected to that connection point whose associated priority value counter has the highest priority value. Consequently, a simple means ensures that it is possible to determine which of the connected accounting devices is to be debited, i.e., which was the last one connected out of the connectable accounting devices.

BRIEF DESCRIPTION OF THE DRAWINGS

The invention will be explained in more detail hereinafter with reference to the accompanying drawings wherein.

DETAILED DISCUSSION OF THE INVENTION

Figure 1:
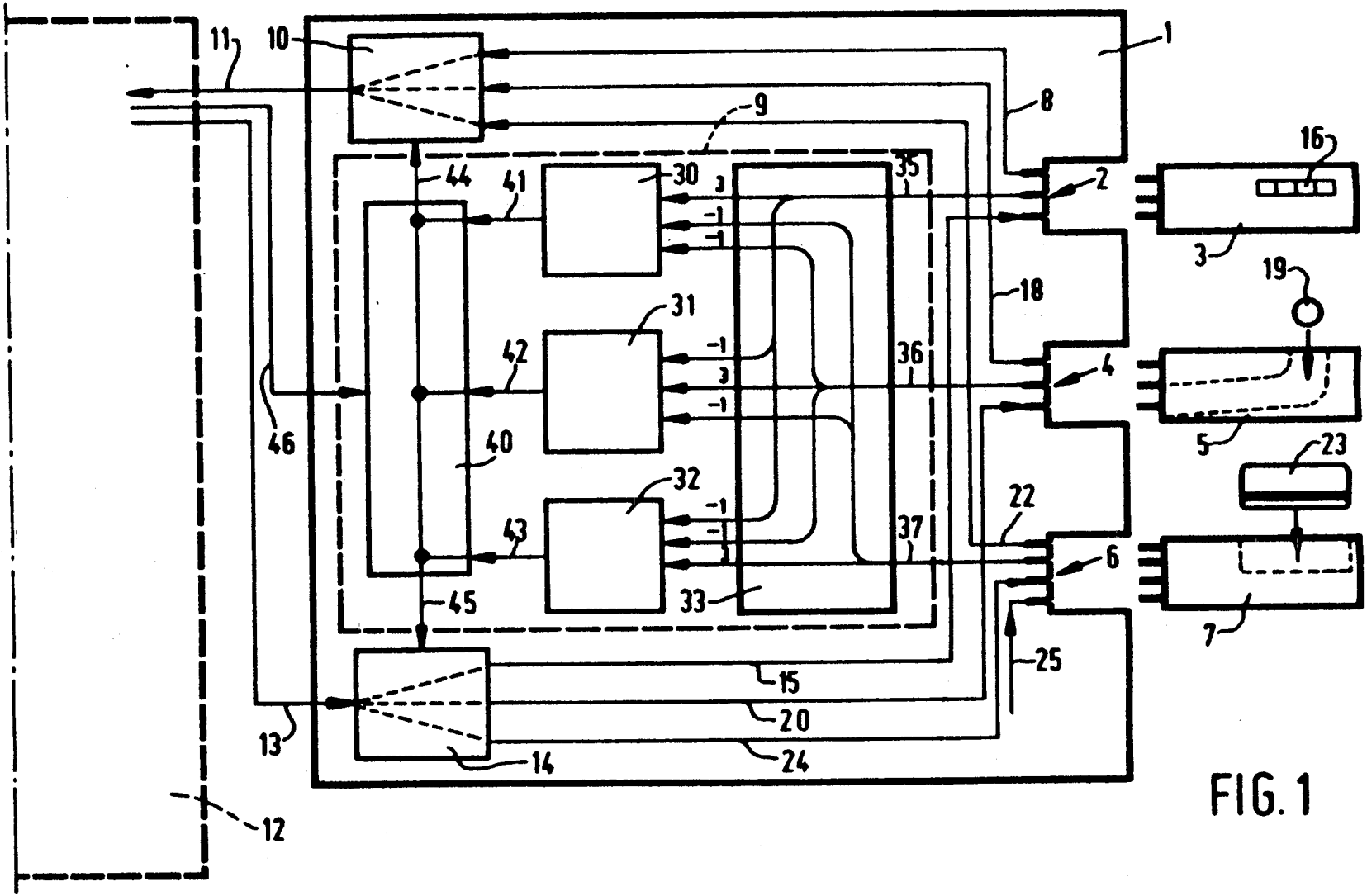
FIG. 1 is a diagram showing a device according to the invention having three connection points for different types of accounting devices.

The device 1 represented in FIG. 1 is provided with a connector 2 as the connection point for connecting a key counter 3 to the device 1, a connection 4 as the connection point for connecting a coin-operated mechanism 5 to the device 1, and a connector 6 as the connection point for connecting a magnetic card reader 7 to the device 1.

When coupled to connector 2, the key counter 3 produces a connection by means of an input level signal 8. In a manner to be described hereinafter, this input level signal 8 can be converted, by a control means 9 in the device 1 by means of a setting switch 10, to an output level signal 11 which is fed to a copying machine 12 coupled to the device 1. Copying machine 12 is adapted to start making a copy only when it receives an output level signal 11. Whenever the copying machine 12 has made a copy it delivers an output pulse signal 13. When key counter 3 is activated, which activation will be explained in detail hereinafter, control means 9 converts the output pulse signal 13 via a setting switch 14 to an output pulse signal 15 which is fed to the key counter 3. In response to a received output pulse signal 15, the instantaneous count of a counter 16 in the key counter 3 is increased by one.

When coupled to connector 4, coin-operated mechanism 5 produces a connection by means of input level signal 18 only if at least one coin 19 has been inserted into the mechanism 5. Under the conditions to be described hereinafter the output level signal 18 can be converted, by the control device 9 by means of setting switch 10, to an output level signal 11 which is fed to the copying machine 12 coupled to the device 1. When the copying machine has produced a copy in response, it delivers an output pulse signal 13. One or more copies can be made depending upon the value of the coin or coins 19 inserted.

If the coin-operated mechanism 5 is adapted to make one copy per coin, then mechanism 5 delivers an output level signal 18 only during a period sufficient for starting the making of a copy. When the copying machine 12 has made the relevant copy, it delivers an output pulse signal 13. In a manner which will be explained hereinafter, the control means 9 can convert this output signal 13, via setting switch 14, to an output pulse signal 20 which is delivered to the coin-operated mechanism 5. In response to the reception of an output pulse signal 20 the inserted coin 19 is processed (drops) and the coin-operated mechanism 5 is released for the insertion of a subsequent coin.

If the coin-operated mechanism 5 is adapted to make a specific number of copies per inserted coin 19, then the output level signal 18 remains present for a period of time sufficient for starting the making of the number of copies and coin 19 does not drop until the number of pulse signals delivered agrees with that specific number of copies.

The coin-operated mechanism 5 can also be adapted to return inserted coins which have not been processed after the required number of copies have been made. The coin-operated mechanism 5 can also be constructed as an automatic change machine which returns a quantity of coins to a value equivalent to the difference between the value of the inserted coins and the relevant charge for the copies made.

In all the embodiments of the coin-operated mechanism 5 described above, the coin-operated mechanism 5 connected to connector 4 generates an output level signal 18, so long as there is at least one unprocessed coin 19 in the mechanism 5.

When the magnetic card reader 7 is coupled to connector 6 it does not produce a connection by means of input level signal 22 until a magnetic card 23 on which a specific copying credit is recorded is located in the magnetic card reader 7. Under the conditions to be described hereinafter, the input level signal 22 is converted, by the control means 9 by means of setting switch 10, to an output level signal 11 which is fed to the copying machine 12 coupled to the device. Each time the copying machine in response thereto has made a copy it delivers an output pulse signal 13. When the magnetic card reader 7 is activated, in the manner to be explained hereinafter, the control means 9 converts the output pulse signal 13, via the setting switch 14, to an output pulse signal 24 which is fed to the magnetic card reader 7. In response to the reception of an output pulse signal the magnetic card reader 7 reduces the recorded copying credit. When the recorded credit runs out, the input level signal 22 disappears. Since subsequent copies may be undergoing processing already at the time when the recorded credit runs out, in which case such copies cannot be debited, the input level signal 22 disappears at a time the recorded credit still has a value corresponding to the number of copies which can be undergoing processing in the copying machine 12 simultaneously. This number can be fed in the form of a signal 25 to the magnetic card reader 7.

The circuit for determining which of the input level signals 8, 18 and 22 is to be transmitted as an input level signal 11 and for determining which of the output pulse signals 15, 20 and 24 is to be transmitted as an output pulse signal 13, will now be explained.

To this end, the control means 9 comprises a priority value counter 30 corresponding to connector 2, a priority value counter 31 corresponding to connector 4, and a priority value counter 32 corresponding to connector 6. Counter setting means 33 can set each counter 30, 31 and 32 to a value 0, a value 1, a value 2, or a value 3. If no accounting device is connected to a connector 2, 4 or 6, the counter setting means 33 sets the counter associated with that connector to 0. The counter setting means 33 receives signals 35, 36 and 37 corresponding to the input level signals 8, 18 and 22. At the time when an accounting device, 3, 5 or 7, is connected to a connector 2, 4 or 6 respectively, and an associated signal 35, 36 or 37 is present, the counter setting means 33 sets the counter associated with the appropriate connector to a value 3 and the counter setting means 33 lowers the value of the counters associated with the other two connectors by 1, at least in so far as a signal 35, 36 or 37 is emitted by the other connectors. If this is not the case, the counters associated with the other two connectors remain at a value 0.

Control means 9 also comprises a comparator circuit 40, to which signals 41, 42 and 43 are fed, which represent the counts of the counters 30, 31 and 32. Comparator circuit 40 compares the signals 41, 42 and 43 and on the basis of the result thereof can deliver a signal 44 to setting switch 10 in order to transmit, as the output level signal 11, that output level signal of the possibly present input level signals 8, 18 and 22 whose associated counter 30, 31 and 32 has a value 3. Also, on the basis of the result of comparison of the signals 41, 42 and 43, the comparator circuit 40 can deliver a signal 45 to the setting switch 14 for transmitting the output pulse signal 13 as output pulse signal 15, 20 or 24 to that connector 2, 4 or 6 whose associated counter 30, 31 or 32 has the value 3. In this way an output pulse signal will always enter at the same connector as that from which the transmitted input level signal originated.

A blocking signal 46 originating from the copying machine 12 coupled to the device 1 can also be fed to the comparator circuit 40. In response to the reception of that signal 46 the circuit 40 blocks any change in the delivered signals 44 and 45. Blocking signal 46 is generated in the copying machine 12 directly after the copying machine has been started by operation of a copying button. The blocking signal remains present until the next operation of the copying button. Thus it is only on each operation of the copying button that the blocking for the change of the signals 44 and 45 is briefly eliminated. The effect of this is that if a credit on the activated accounting device runs out during the execution of a copying run comprising a number of copies, such run being automatically executed after operation of the copying button, the remaining copies are unintentionally charged to another connected accounting device.

An intermediate copying run executed during an interruption of a current copying run can be charged to another accounting device connected only during the interruption, because the execution of such an intermediate copying run starts by operation of the copying button.

The operation of the device represented in FIG. 1 and described hereinabove is explained in further detail by means of the flow diagrams in FIGS. 2, 3 and 4.

Figure 2A:
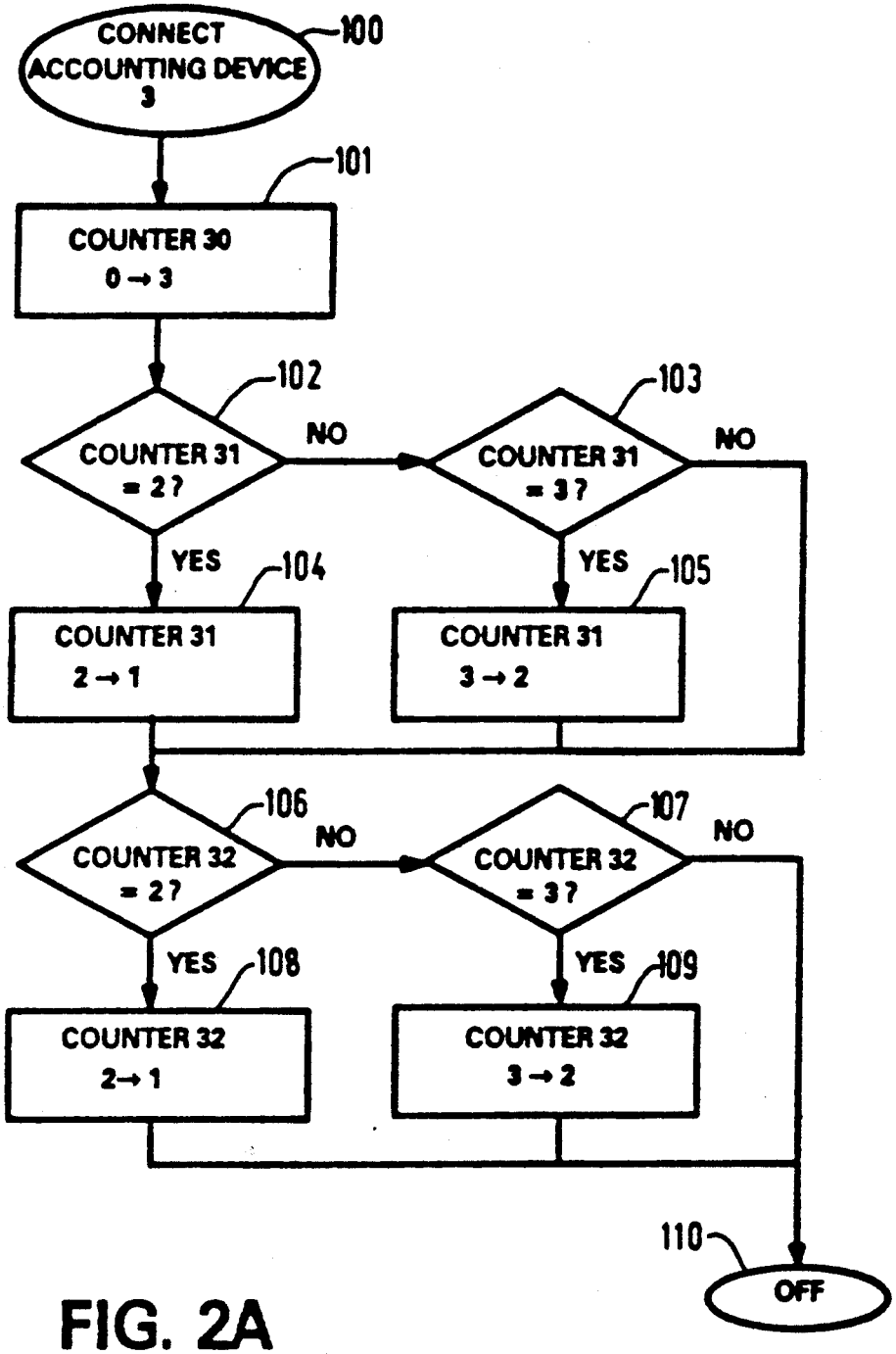
FIGS. 2A and 2B are flow diagrams of respective connection (make) and disconnection (break) of a connection at the first connection point.

The flow diagram represented in FIG. 2A describes the changes of the priority counter values of the counters 30, 31 and 32 of the device of FIG. 1 upon the connection of the accounting device 3. When accounting device 3 is connected (step 100) the associated counter 30 is set to a value 3 (step 101). After this the current priority value of the counter 31 is determined. If the priority value of this counter is 2 or 3 the priority value is decremented by 1 (steps 102–105). If the priority value is 1 (lowest priority) or 0 (accounting device not present) no decrement is necessary. In steps 106 and 107 the current priority value of counter 32 is determined. If the priority value of this counter is 2 or 3 the priority value is decremented by 1 (steps 108–109).

Figure 2B:
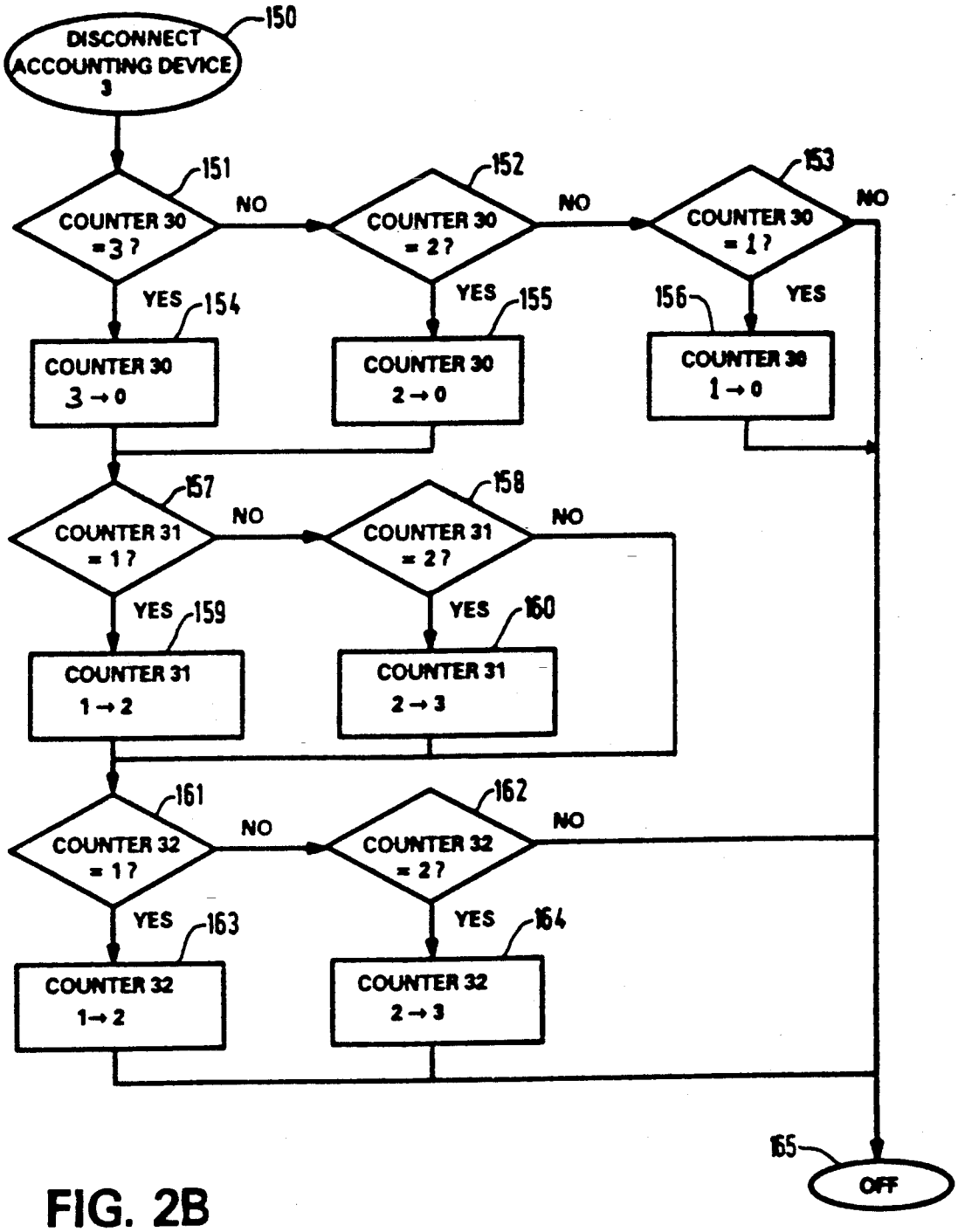

The flow diagram represented by FIG. 2B describes the changes in the priority counter values of the counters 30, 31 and 32 of the device of FIG. 1 upon disconnection of accounting device 3. When this accounting device is disconnected the associated counter 30 is set to a priority value 0 (steps 151–156). The other counters 31 and 32 are then adjusted if necessary (steps 157–164). If the priority value is 1 (lowest priority) the other counters 31 and 32 are not adjusted (step 165). If counter 31 has a priority value 1 (step 157) or 2 (step 158) the value is incremented by 1 to 2 (step 159) or 3 (step 160) respectively. When the counter 31 has a priority value of 0 or 3 the counter is not adjusted. Then the other counter 32 is adjusted is necessary. If counter 32 has a priority value of 1 (step 161) or 2 (step 162) the value of counter 32 is incremented by 1 (step 163 and step 164). If the priority value is 0 or 3 then the value is not adjusted.

Figure 3A:
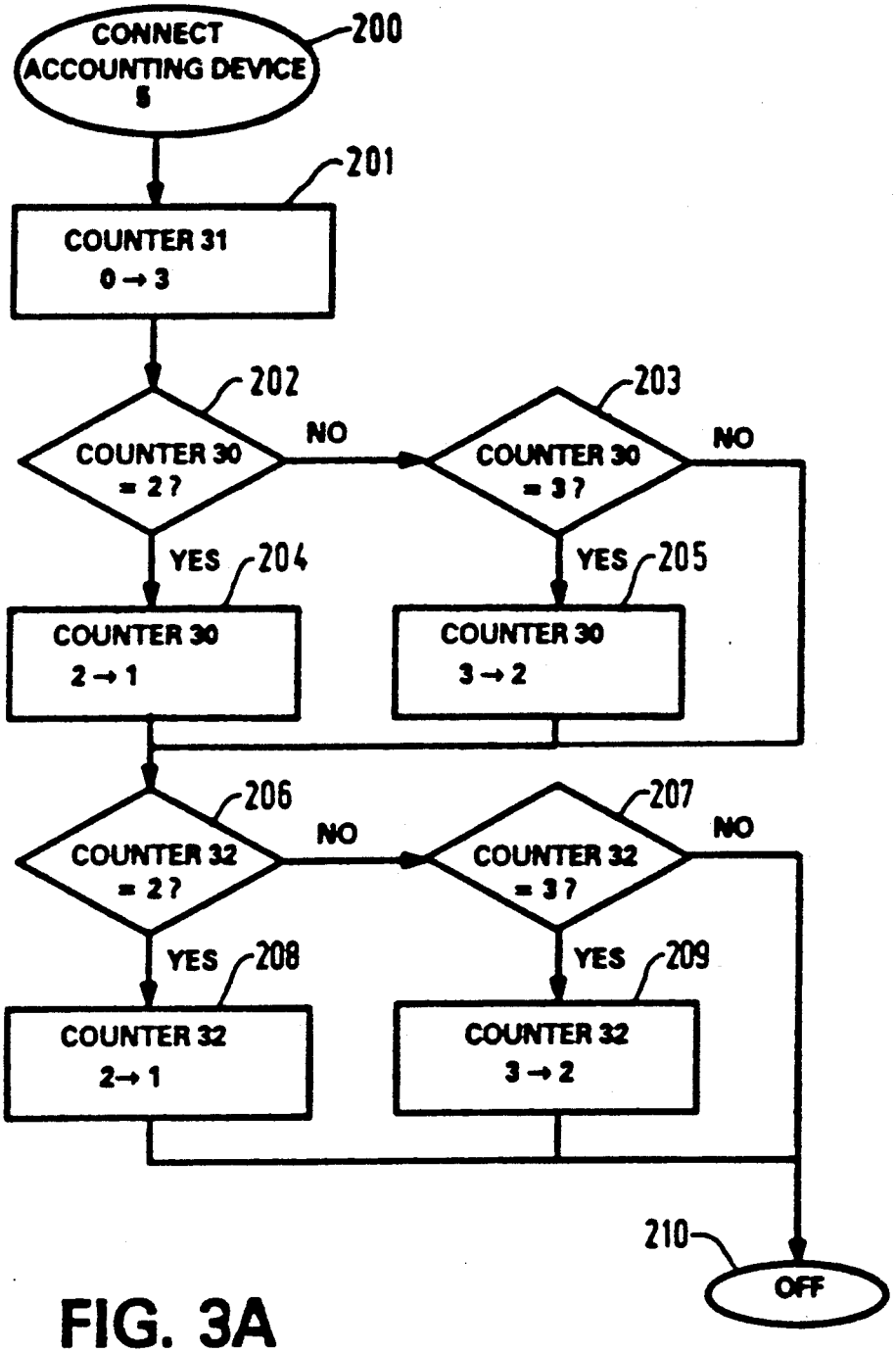
FIGS. 3A and 3B are flow diagrams of respective connection (make) and disconnection (break) of a connection at the second connection point.

The flow diagram represented by FIG. 3A describes the changes of the priority counter values of the counters 30, 31 and 32 of the device of FIG. 1 upon the connection of the accounting device 5. When accounting device 5 is connected (step 200) the associated counter 31 is set to a value 3 (step 201). After this the current priority value of the counter 30 is determined. If the priority value of this counter is 2 or 3 the priority value is decremented by 1 (steps 202–205). If the priority value is 1 (lowest priority) or 0 (accounting device is not present) no decrement is necessary. In steps 206 and 207 the current priority value of counter 32 is determined. If the priority value of this counter is 2 or 3 the priority value is decremented by 1 (steps 208–209).

Figure 3B:
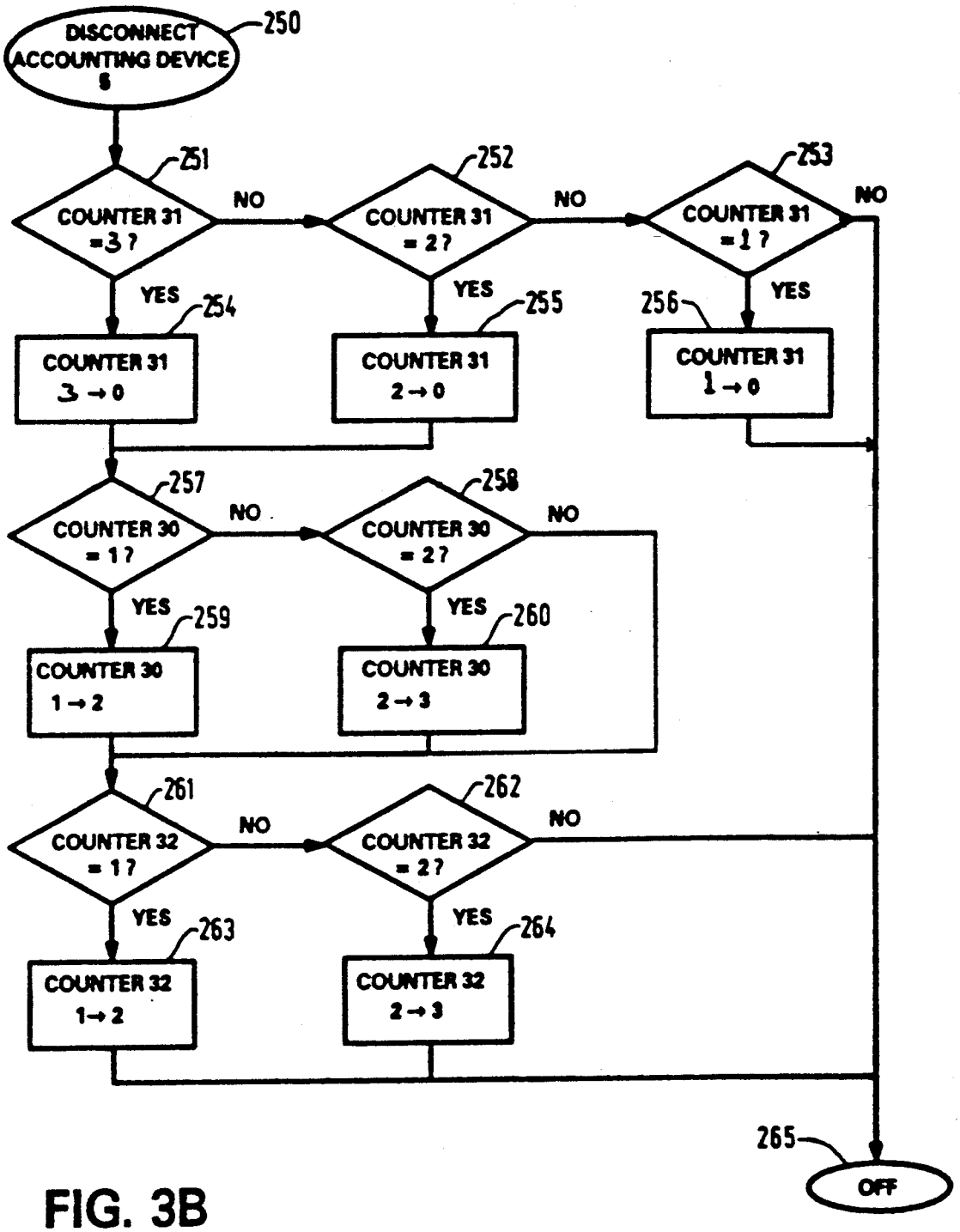

The flow diagram represented in FIG. 3B describes the changes in the priority counter values of the counters 30, 31 and 32 of the device of FIG. 1 upon disconnection of accounting device 5. When this accounting device is disconnected the associated counter 31 is set to a priority value 0 (steps 251–256). The other counters 30 and 32 are then adjusted if necessary (steps 257–264). If the priority value is 1 (lowest priority) the other counters 30 and 32 are not adjusted (step 265). If counter 30 has a priority value 1 (step 257) or 2 (step 258) the value is incremented by 1 to 2 (step 259) or 3 (step 260) respectively. When the counter 30 has a priority value of 0 or 3 the counter is not adjusted. Then the other counter 32 is adjusted if necessary. If counter 32 has a priority value of 1 (step 261) or 2 (step 262) the value of counter 32 is incremented by 1 (step 263 and step 264). If the priority value is 0 or 3 then the value is not adjusted.

Figure 4A:
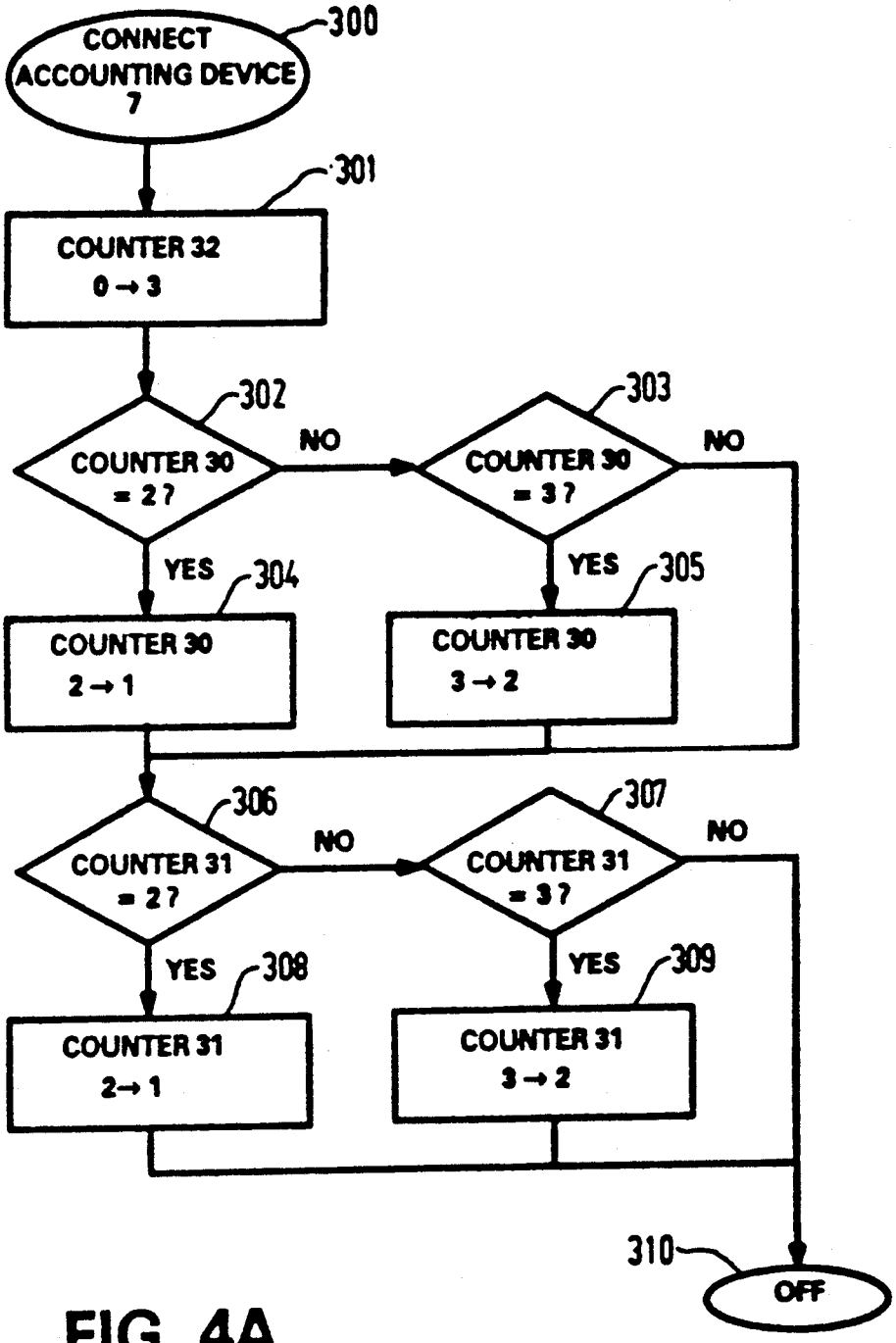
FIGS. 4A and 4B are flow diagrams of respective connection (make) and disconnection (break) of a connection at the third connection point.

The flow diagram represented in FIG. 4A describes the changes in the priority counter values of the counters 30, 31 and 32 of the device of FIG. 1 upon the connection of accounting device 7. When accounting device 7 is connected (step 300) the associated counter 3 is set to a value 3 (step 301). After this the current priority value of the counter 30 is determined. If the priority value of this counter 30 is 2 or 3 the priority value is decremented by 1 (steps 302–305). If the priority value is 1 (lowest priority) or 0 (accounting device not present) no decrement is necessary. In step 306 and 307 the current priority value of counter 31 is determined. If the priority value of this counter is 2 or 3 the priority value is decremented by 1 (steps 308–309).

Figure 4B:
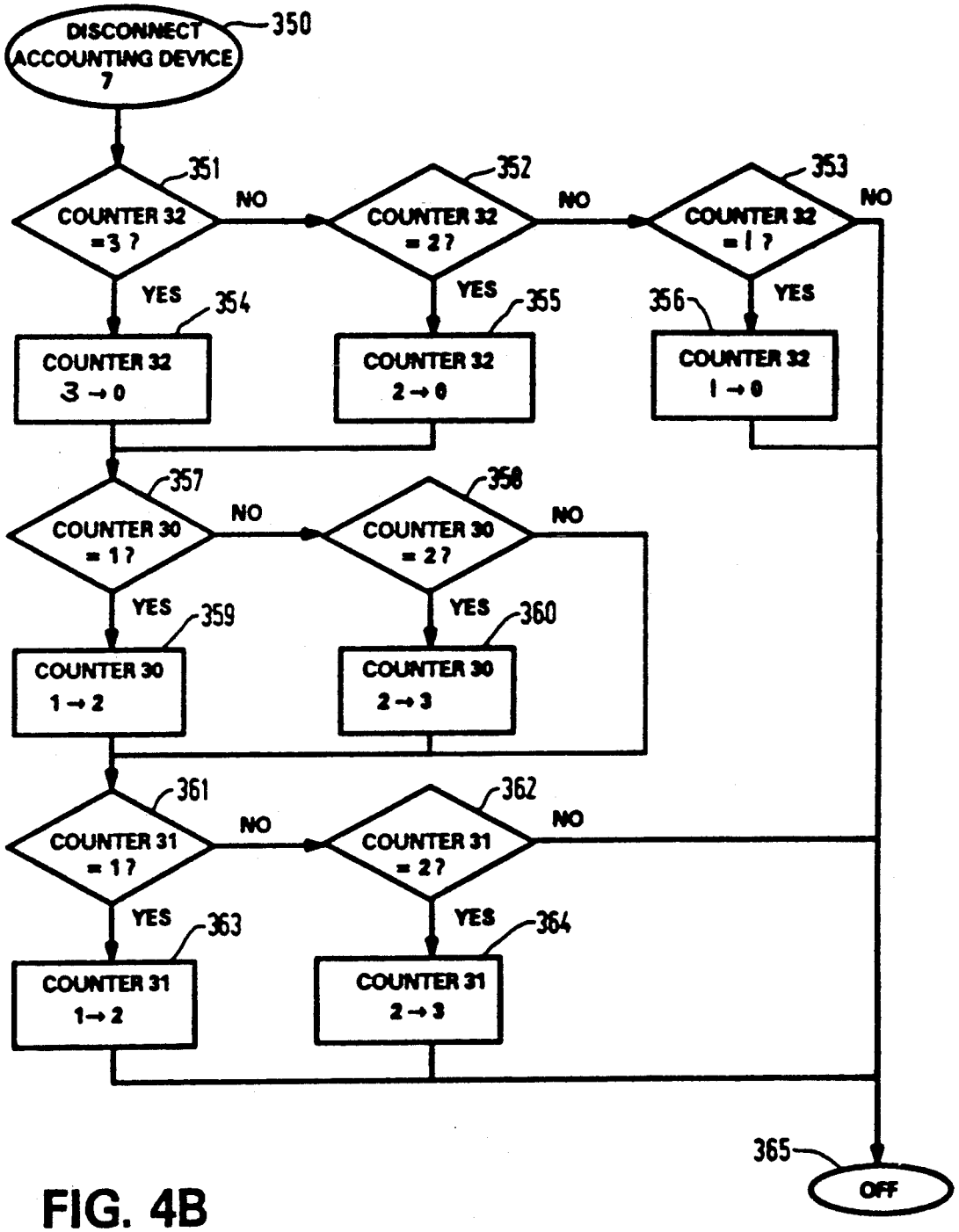

The flow diagram represented in FIG. 4B describes the changes in the priority counter values of the counters 30, 31 and 32 of the device of FIG. 1 upon disconnection of accounting device 7. When this accounting device is disconnected the associated counter 32 is set to a priority value 0 (steps 351–356). The other counters 30 and 31 are then adjusted if necessary (steps 357–364). If the priority value is 1 (lowest priority) the other counters 30 and 31 are not adjusted (step 365). If counter 30 has a priority value 1 (step 357) or 2 (step 358) the value is incremented by 1 to 2 (step 359) or 3 (step 360) respectively. When the counter 30 has a priority value of 0 or 3 the counter is not adjusted. Then the other counter 31 is adjusted if necessary. If counter 31 has a priority value of 1 (step 361) or 2 (step 362) the value of counter 31 is incremented by 1 (step 363 and step 364). If the priority value is 0 or 3 then the value is not adjusted.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for selectively recording charges for copies made on a copying machine by way of two or more accounting means connected at the same time via said device to said copying machine, comprising means for coupling said device to said copying machine, a plurality of connection points each one of which is connectable separately to a different accounting means and control means which selectively activates one of said accounting means for recording of said charges while deactivating those remaining of said two or more accounting means.

2. The device of claim 1, wherein said control means comprises a plurality of priority value counters each corresponding to a different connection point, a counter setting means which sets one of said priority value counters to a highest priority value when a connection is made between a connection point corresponding to said one of said priority value counters and an accounting means, said counter setting means setting said priority value counter to a lower priority value whenever, on connection of an accounting means to a connection point corresponding to said priority value counter, a connection is made between another connection point and another accounting means, and sets said priority value counter to a priority value of 0 when connection between a connection point corresponding to said priority value counter and an accounting means is interrupted.

3. The device of claim 2, further including a switching means for activating, during copying, the accounting means which is connected to the connection point associated with the priority value counter having a highest priority value.

4. The device according to claim 3, wherein at least one of said accounting means is of a type whereby a debitable credit can be recorded, and said control means is adapted to receive a blocking signal originating from said copying machine coupled to said device whereby said control means, in response to receipt of said blocking signal, prevents said switching means from switching over from said activated accounting means to another connected accounting means.

5. A system for recording charges for copies made on a copying machine which comprises in combination:

a copying machine for reproducing copies, a plurality of different accounting means for recording charges for said copies, and a device coupled to said copying machine for selectively recording charges against one of said different accounting means for copies made by said copying machine, said device including a plurality of connection points each one of which is connectable separately to one of said different accounting means and control means which selectively activates one of said different accounting means and deactivates those remaining of said plurality of different accounting means, while all of said different accounting means remain connected by way of said connection points via said device to said copying machine.

6. The system of claim 5, wherein said control means comprises:

a plurality of priority value counters each corresponding to a different connection point, a counter setting means which sets one of said priority value counters to a highest priority value when a connection is made between a connection point corresponding to said one of said priority value counters and an accounting means, said counter setting means setting said priority value counter to a lower priority value whenever, on connection of an accounting means to a connection point corresponding to said priority value counter, a connection is made between another connection point and another accounting means, and sets said priority value counter to a priority value of 0 when connection between a connection point corresponding to said priority value counter and an accounting means is interrupted.

7. The system of claim 6, further including a switching means for activating, during copying, the accounting means which is connected to the connection point associated with the priority value counter having the highest priority value.

8. The system of claim 6, wherein said accounting means are inclusive of a key counter, a coin-operated mechanism and a magnetic card reader.

9. The system of claim 7, wherein said control means is adapted to receive a blocking signal originating from said copying machine coupled to said device whereby said control means, in response to receipt of said blocking signal, prevents said switching means from switching over from said activated accounting means to another connected accounting means.

10. A method for selectively recording charges for copies made on a copying machine by way of a plurality of different accounting means separately connectable to said copying machine, without disconnecting any of said different accounting means, comprising:

providing a device for connecting a copying machine to a plurality of different accounting means via a plurality of connection points corresponding to each of said different accounting means, and selectively activating a predetermined one of said plurality of different accounting means so as to record copying charges while at the same time deactivating, without disconnecting, those remaining of said plurality of different accounting means.

11. The method of claim 10, wherein said predetermined accounting means activated is the last accounting means connected of the plurality of different accounting means connected.

* * * * *